US008415576B2

(12) United States Patent
Lu

(10) Patent No.: US 8,415,576 B2
(45) Date of Patent: Apr. 9, 2013

(54) OPERATING MECHANISM FOR CENTRIFUGAL SWITCH

(75) Inventor: Ping Lu, Zhongshan (CN)

(73) Assignee: Zhongshan Broad-Ocean Motor Co., Ltd., Zhongshan (CN)

( * ) Notice: Subject to any disclaimer, the term of this patent is extended or adjusted under 35 U.S.C. 154(b) by 352 days.

(21) Appl. No.: 12/831,287

(22) Filed: Jul. 7, 2010

(65) Prior Publication Data

US 2011/0011718 A1 Jan. 20, 2011

(30) Foreign Application Priority Data

Jul. 15, 2009 (CN) ..... 2009 2 0060796 U

(51) Int. Cl.
*H01H 35/10* (2006.01)

(52) U.S. Cl.
USPC ..... 200/80 R; 310/68 E

(58) Field of Classification Search ..... *H01H 35/10*
See application file for complete search history.

(56) References Cited

U.S. PATENT DOCUMENTS

| | | | | |
|---|---|---|---|---|
| 4,296,366 | A * | 10/1981 | Hildebrandt et al. | 318/793 |
| 4,670,631 | A * | 6/1987 | Peachee et al. | 200/80 R |
| 6,710,271 | B2 * | 3/2004 | Spedale et al. | 200/80 R |
| 6,982,507 | B2 * | 1/2006 | Lin | 310/68 E |

* cited by examiner

*Primary Examiner* — Vanessa Girardi
(74) *Attorney, Agent, or Firm* — Matthias Scholl P.C.; Matthias Scholl

(57) ABSTRACT

An operating mechanism for a centrifugal switch contains at least: a terminal box, a cover, a movable contact, a static contact, a swing arm, a reset elastic part, and a shifting fork. The movable contact and the static contact are disposed in the terminal box. The shifting fork operates to drive the swing arm to horizontally swing, whereby pushing the movable contact and implementing connection and disconnection between the movable contact and the static contact. The reset elastic part operates to automatically reset the shifting fork and the swing arm. The invention features reduced requirements for dimensional precision and installation precision of components, and low production cost, and is reliable and durable. In addition, the sliding force is uniformly stressed, which ensures accuracy of operation, easy installation, and high operating reliability.

5 Claims, 9 Drawing Sheets

OPERATING MECHANISM FOR CENTRIFUGAL SWITCH

CROSS-REFERENCE TO RELATED APPLICATIONS

Pursuant to 35 U.S.C. §119 and the Paris Convention Treaty, this application claims the benefit of Chinese Patent Application No. 200920060796.4 filed on Jul. 15, 2009, the contents of which are incorporated herein by reference.

BACKGROUND OF THE INVENTION

1. Field of the Invention

The invention relates to an operating mechanism for a centrifugal switch.

2. Description of the Related Art

Centrifugal switches are widely used nowadays. A conventional centrifugal switch comprises a sliding plate, a weight, a spring, and a base. The weight overcomes resistance of the spring and drives the sliding plate to slide upwards or downwards, whereby enabling an operating mechanism of the centrifugal switch to switch on or off a power supply of a motor.

A conventional operating mechanism for a centrifugal switch comprises a terminal box, a cover, a static contact, a movable contact, a swing arm, and a reset elastic part, and the swing arm comprises an outer arm disposed outside the terminal box, and an inner arm disposed in the terminal box. A connection point between the outer arm and the inner arm is hinged on the terminal box, and the movable contact and the static contact are disposed in the terminal box. The inner arm operates to push the movable contact, and the outer arm is fit with the sliding plate. However, there are several problems with such an operating mechanism: firstly, structure thereof is complex, and requirements for dimensional precision and installation precision of components are high; secondly, production cost thereof is high; and finally, as the sliding plate and a rotating shaft rotates at a high speed, the top of the outer arm is contacted with an edge of the sliding plate via only one point, which affects accurate operation of the operating mechanism, and causes fast abrasion thereof.

SUMMARY OF THE INVENTION

In view of the above-described problem, it is one objective of the invention to provide an operating mechanism for a centrifugal switch that is capable of addressing the above-mentioned problems.

To achieve the above objectives, in accordance with one embodiment of the invention, provided is an operating mechanism for a centrifugal switch, comprising a terminal box, a cover, a movable contact, a static contact, a swing arm, a reset elastic part, and a shifting fork. The movable contact and the static contact are disposed in the terminal box; the shifting fork operates to drive the swing arm to horizontally swing, whereby pushing the movable contact and implementing connection and disconnection between the movable contact and the static contact; and the reset elastic part operates to automatically reset the shifting fork and the swing arm.

In a class of this embodiment, the swing arm is disposed in the terminal box, one end of the swing arm is hinged on the terminal box and capable of swinging with respect to a hinge point thereof, and the front of the swing arm pushes the movable contact.

In a class of this embodiment, the reset elastic part comprises a compression spring and a torsion spring.

In a class of this embodiment, the compression spring is disposed in the terminal box, and one end of the compression spring abuts against the swing arm.

In a class of this embodiment, a pair of protruding ears is extended from the terminal box, and the middle of the shifting fork is hinged on the protruding ear via a pin shaft.

In a class of this embodiment, the torsion spring is fit on the pin shaft and applies force on the shifting fork.

In a class of this embodiment, a pushing bar is disposed on a tail-end of the shifting fork, and the pushing bar compresses the swing arm.

In a class of this embodiment, an opening is disposed on the terminal box, and the pushing bar extends into the terminal box via the opening.

In a class of this embodiment, the centrifugal switch comprises a sliding plate, a weight, a spring, and a base.

In a class of this embodiment, the top of the shifting fork compresses that of the sliding plate of the centrifugal switch.

In a class of this embodiment, the top of the shifting fork forms a fork-shaped portion.

In a class of this embodiment, the middle of the fork-shaped portion forms an arc-shaped groove.

Advantages of the invention include the following: 1) rotation of the shifting fork drives the swing arm to horizontally swing whereby pushing the movable contact and implementing connection and disconnection between the movable contact and the static contact, which reduces requirements for dimensional precision and installation precision of components and production cost, and makes the invention reliable and durable; 2) the fork-shaped portion and the arc-shaped groove enable the sliding force to be uniformly stressed, which ensures accuracy of operation; 3) the top of the shifting fork can be contacted with any position at the top of the sliding plate, and contact area therebetween is large enough, which facilitate easy installation and high operating reliability.

BRIEF DESCRIPTION OF THE DRAWINGS

Detailed description will be given below in conjunction with accompanying drawings, in which:

FIG. 2 is a perspective view of an operating mechanism of the invention as a centrifugal switch is switched on;

FIG. 3 is a front view of an operating mechanism of the invention as a centrifugal switch is switched on;

DETAILED DESCRIPTION OF THE EMBODIMENTS

Figure 1:
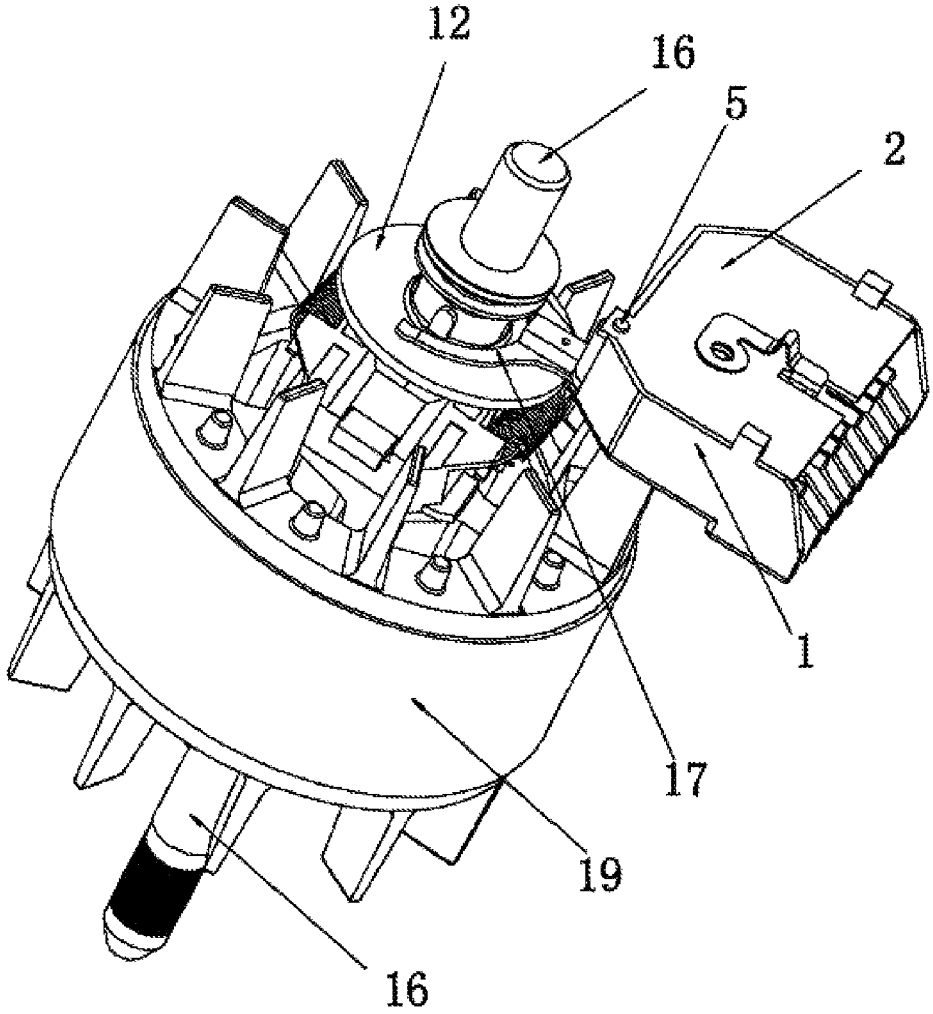
FIG. 1 is a schematic view of an operating mechanism for a centrifugal switch of an exemplary embodiment of the invention.
Figure 2:
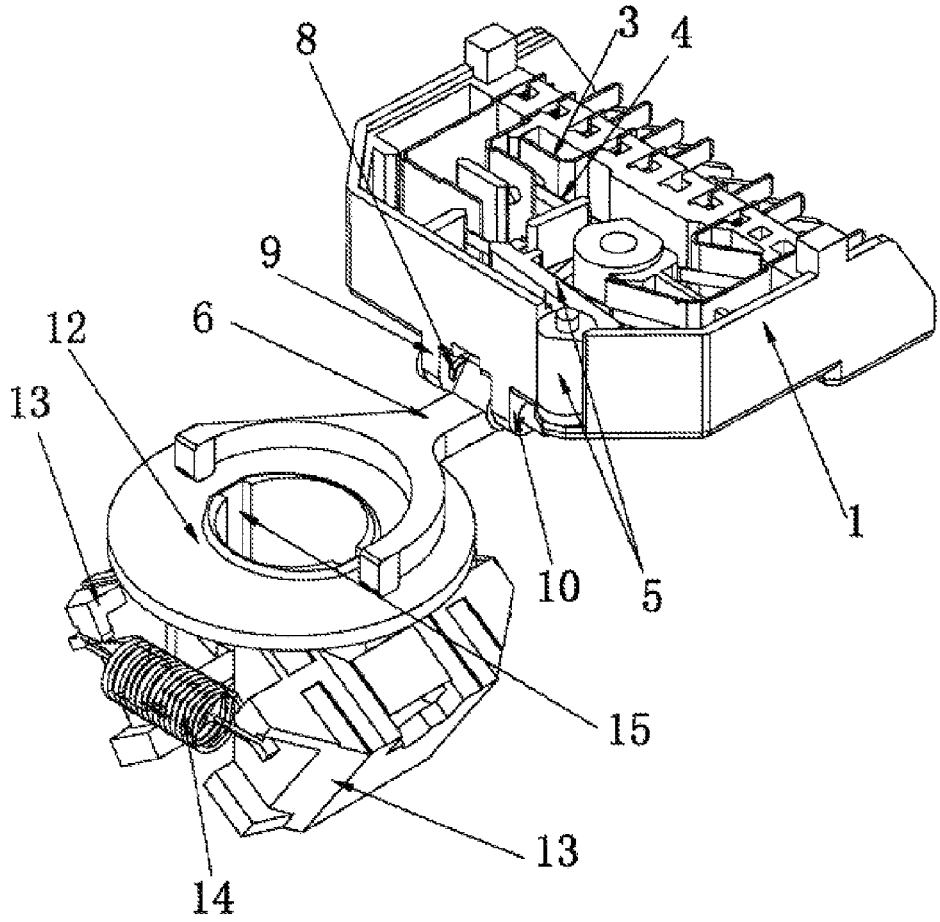
Figure 3:
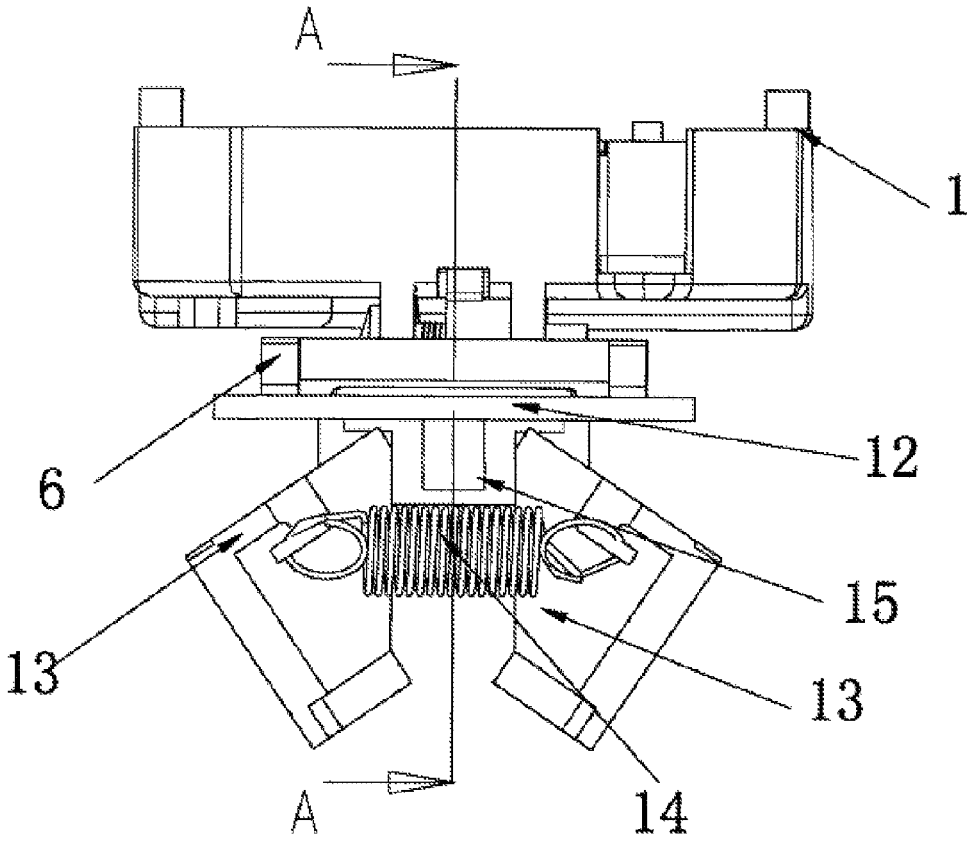
Figure 4:
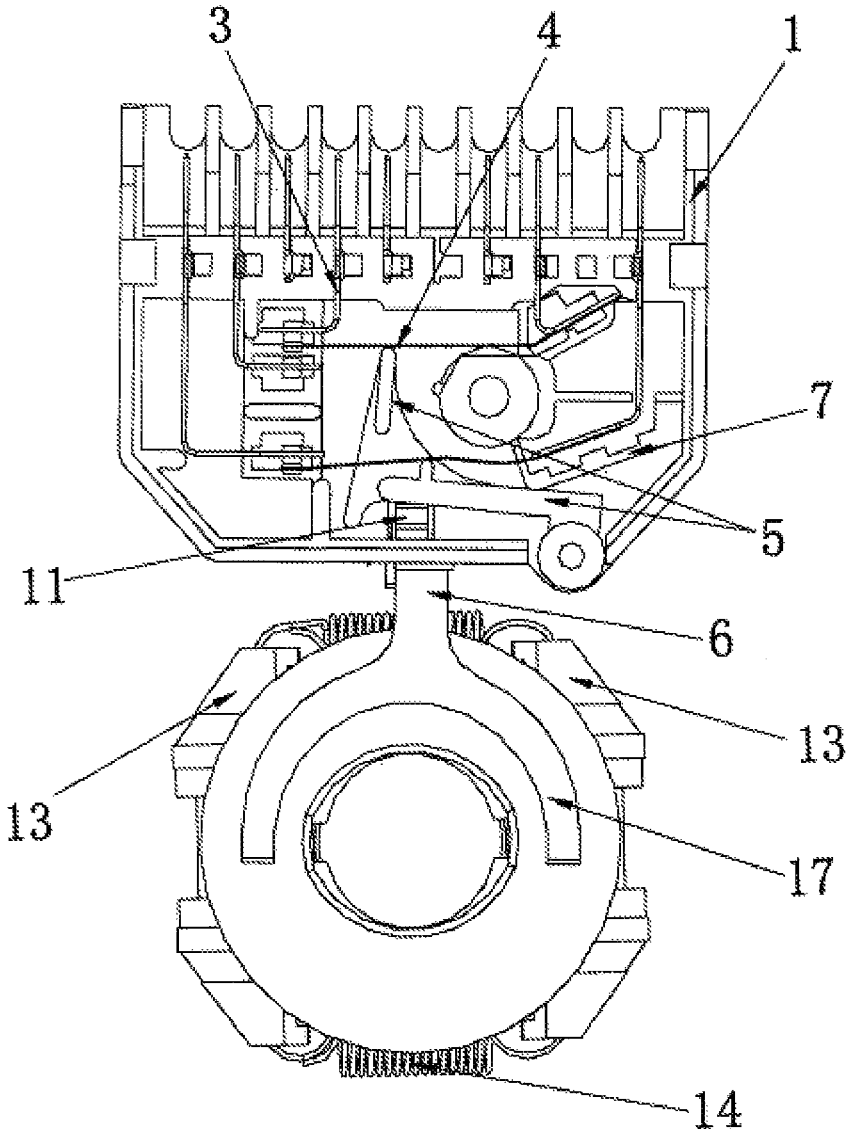
FIG. 4 is a bottom view of an operating mechanism in FIG. 3.
Figure 5:
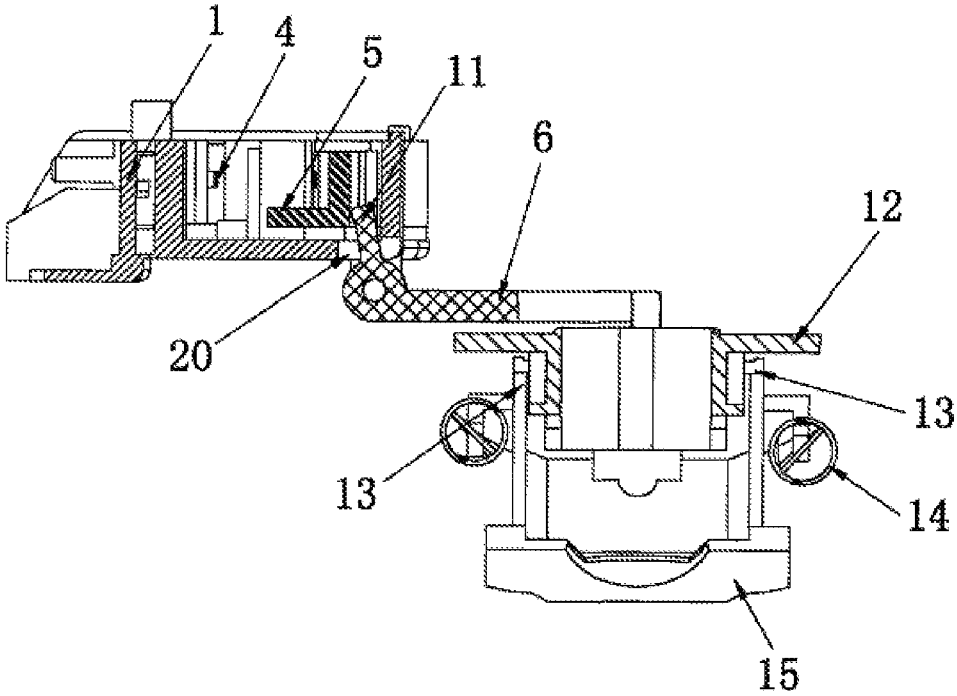
FIG. 5 is a cross-sectional view of an operating mechanism along an A-A line in FIG. 3.
Figure 6:
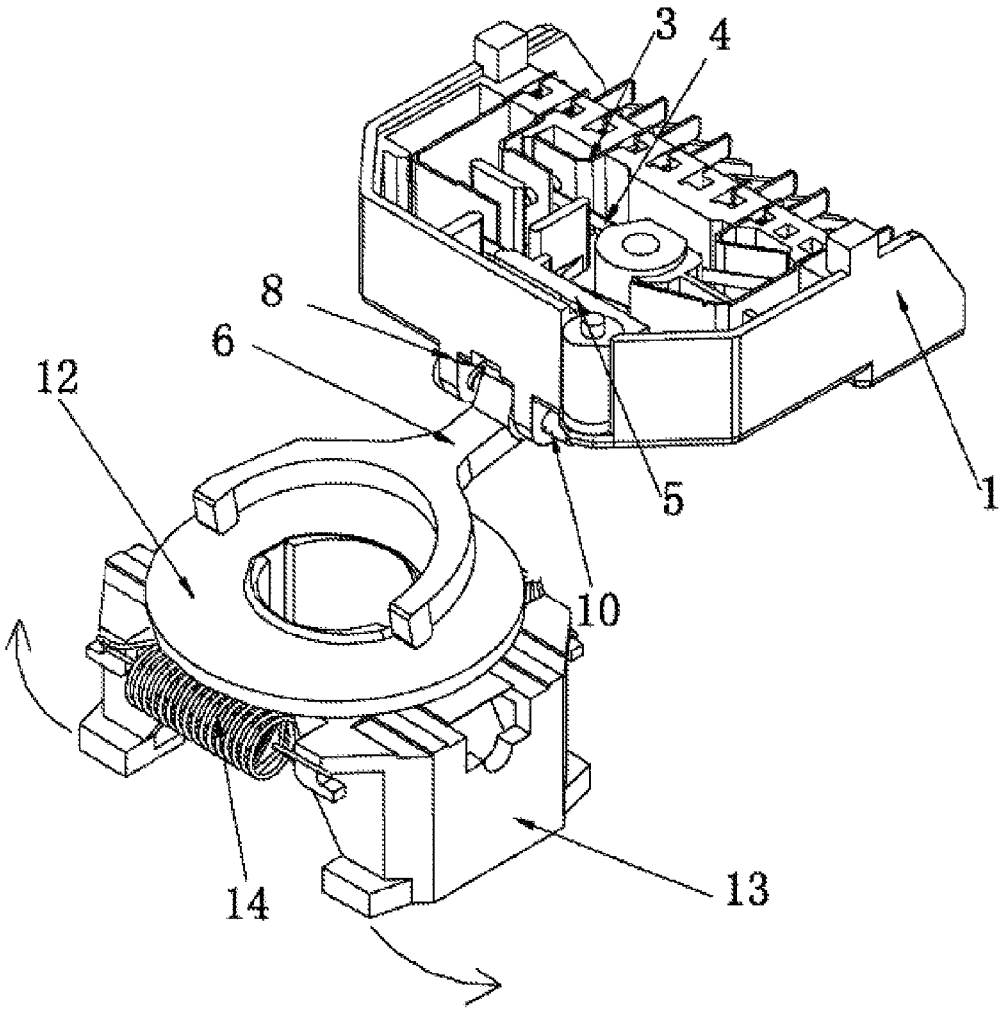
FIG. 6 is a perspective view of an operating mechanism of the invention as a centrifugal switch is switched off.
Figure 7:
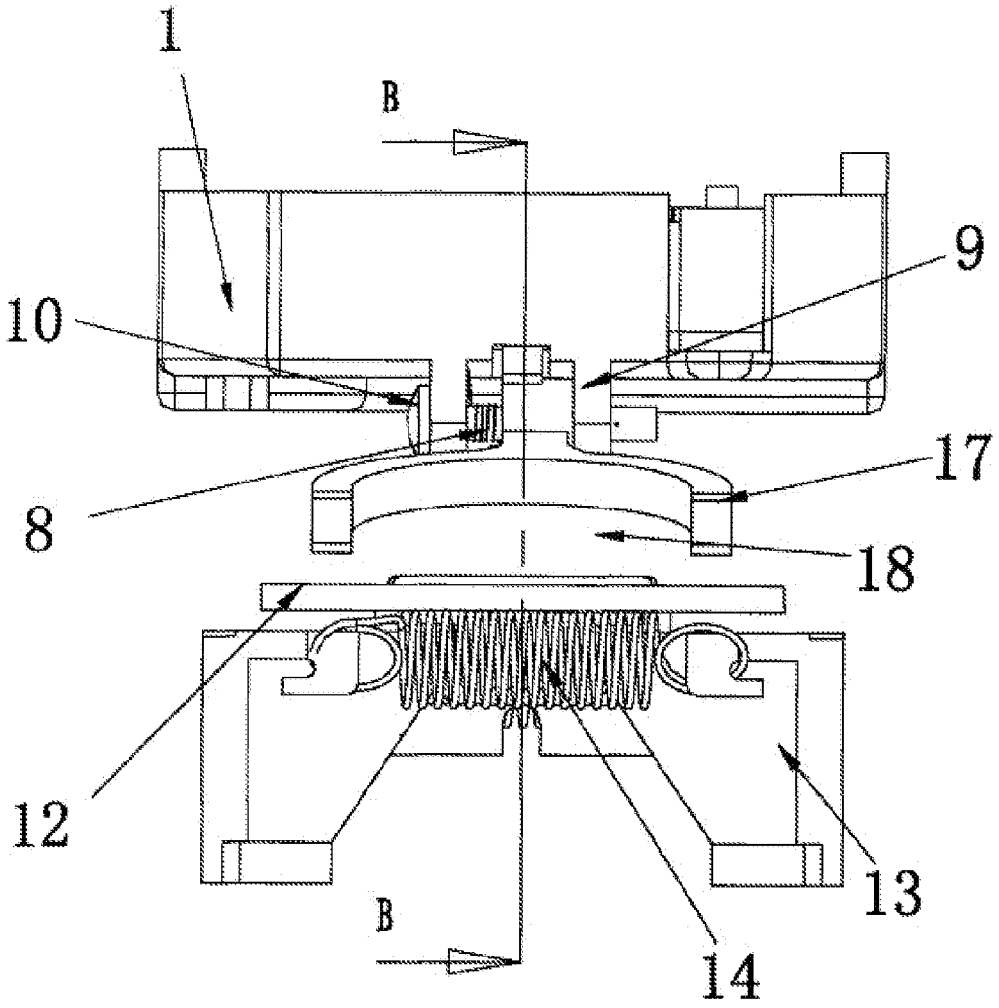
FIG. 7 is a front view of an operating mechanism of the invention as a centrifugal switch is switched off.
Figure 8:
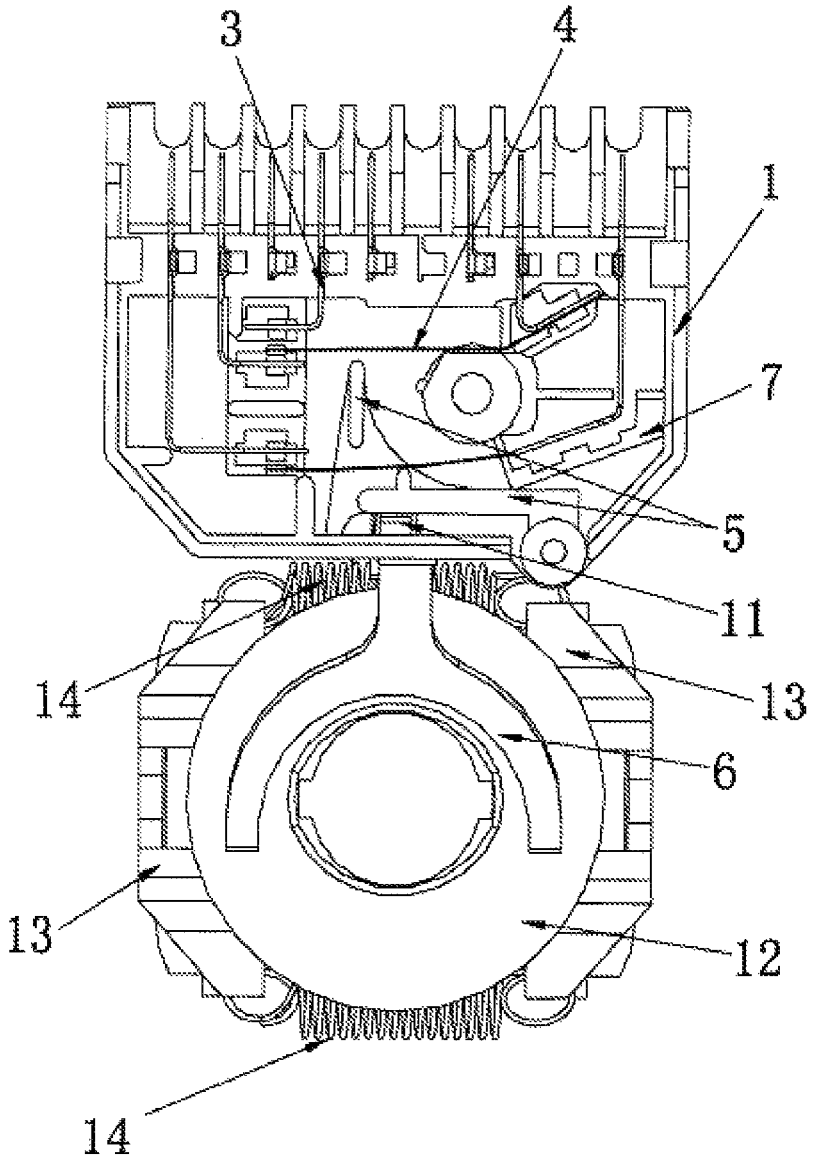
FIG. 8 is a top view of an operating mechanism in FIG. 7.
Figure 9:
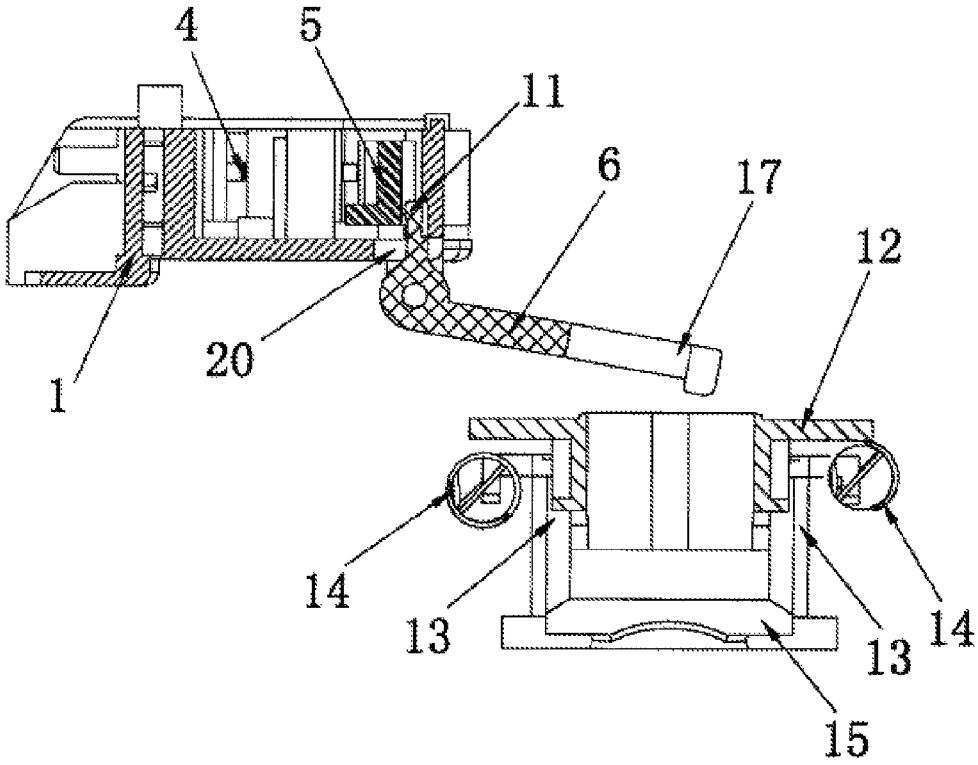
FIG. 9 is a cross-sectional view of FIG. 7 along a B-B line.

As shown in FIGS. 1-9, an operating mechanism for a centrifugal switch of the invention comprises a terminal box 1, a cover 2, a static contact 3, a movable contact 4, a swing arm 5, a reset elastic part, and a shifting fork 6. The centrifugal switch comprises a sliding plate 12, a weight 13, a spring 14, and a base 15.

The movable contact 4 and the static contact 3 are disposed in the terminal box 1.

Operation of the shifting fork 6 operates to drive the swing arm 5 to horizontally swing whereby pushing the movable contact 4 and implementing connection and disconnection between the movable contact 4 and the static contact 3.

The reset elastic part operates to automatically reset the shifting fork 6 and the swing arm 5.

The swing arm 5 is disposed in the terminal box 1, one end of the swing arm 5 is hinged on the terminal box 1 and capable of swinging with respect to a hinge point thereof, and the front of the swing arm 5 pushes the movable contact 4.

The reset elastic part comprises a compression spring 7 and a torsion spring 8.

The compression spring 7 is disposed in the terminal box 1, and one end of the compression spring 7 abuts against the swing arm 5.

A pair of protruding ears 9 is extended from the terminal box 1, and the middle of the shifting fork 6 is hinged on the protruding ear 9 via a pin shaft 10.

The torsion spring 8 is fit on the pin shaft 10 and applies force on the shifting fork 6.

A pushing bar 11 is disposed on a tail-end of the shifting fork 6, and the pushing bar 11 compresses the swing arm 5.

An opening 19 is disposed on the terminal box 1, and the pushing bar 11 extends into the terminal box 1 via the opening 19.

The top of the shifting fork 6 compresses that of the sliding plate 12 of the centrifugal switch.

The top of the shifting fork forms a fork-shaped portion 17.

The middle of the fork-shaped portion 17 forms an arc-shaped groove 18.

A gap 20 is disposed on the terminal box 1, and the pushing bar 11 disposed on the tail-end of the shifting fork 6 extends into the terminal box 1 via the gap 20.

Operation principle of the invention is as follows: As an operating speed of a rotor 19 of a motor is within an allowable range, the static contact 3 is connected to the movable contact 4, the weight 13 abuts against the sliding plate 12 under the action of the spring 14 whereby enabling the sliding plate 12 to abut against the top of the shifting fork 6. At this time, the shifting fork 6 rotates with respect to the pin shaft 10. The pushing bar 11 disposed on the tail-end of the shifting fork 6 presses the swing arm 5, the swing arm 5 swings with respect to the hinge point, and the top of the swing arm 5 pushes the movable contact to abut against the static contact 3. As an operating speed of the motor exceeds the allowable range, the weight 13 overcomes resistance of the spring 14 and drives the sliding plate 12 to move downwards. The fork-shaped portion 17 of the shifting fork 6 does not apply force thereon, the torsion spring 8 forces the shifting fork 6 to rotate with respect to the pin shaft 10 in a reversed direction. At this time the pushing bar 11 disposed on the tail-end of the shifting fork 6 is detached from the swing arm 5, the swing arm 5 swings with respect to the hinge point in a reversed direction, the top of the swing arm 5 is detached from the movable contact 4, and the movable contact 4 is automatically detached from the static contact 3. Thus the static contact 3 is disconnected from the movable contact 4.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An operating mechanism for a centrifugal switch, the operating mechanism comprising:

a terminal box;
a cover;
a movable contact;
a static contact;
a swing arm;
a reset elastic part; and
a shifting fork;

wherein said movable contact and said static contact are disposed in said terminal box;
said shifting fork operates to drive said swing arm to horizontally swing, whereby pushing said movable contact and implementing connection and disconnection between said movable contact and said static contact;
said reset elastic part operates to automatically reset said shifting fork and said swing arm;
said reset elastic part comprises a compression spring and a torsion spring;
said compression spring is disposed in said terminal box; and
one end of said compression spring abuts against said swing arm.

2. An operating mechanism for a centrifugal switch, the operating mechanism comprising:

a terminal box;
a cover;
a movable contact;
a static contact;
a swing arm;
a reset elastic part; and
a shifting fork having a middle;

wherein said movable contact and said static contact are disposed in said terminal box;
said shifting fork operates to drive said swing arm to horizontally swing, whereby pushing said movable contact and implementing connection and disconnection between said movable contact and said static contact;
said reset elastic part operates to automatically reset said shifting fork and said swing arm;
said reset elastic part comprises a compression spring and a torsion spring;
a pair of protruding ears are extended from said terminal box; and
the middle of said shifting fork is hinged on said protruding ears via a pin shaft.

3. The operating mechanism of claim 2, wherein said torsion spring is fit on said pin shaft.

4. An operating mechanism for a centrifugal switch, the operating mechanism comprising:

a terminal box;
a cover;
a movable contact;
a static contact;
a swing arm;
a reset elastic part; and
a shifting fork;

wherein:

said movable contact and said static contact are disposed in said terminal box;

said shifting fork operates to drive said swing arm to horizontally swing, whereby pushing said movable contact and implementing connection and disconnection between said movable contact and said static contact;

said reset elastic part operates to automatically reset said shifting fork and said swing arm;

said swing arm is disposed in said terminal box;

one end of said swing arm is hinged on said terminal box and capable of swinging with respect to a hinge point thereof;

the front of said swing arm pushes said movable contact;

said reset elastic part comprises a compression spring and a torsion spring;

said compression spring is disposed in said terminal box; and one end of said compression spring abuts against said swing arm.

5. An operating mechanism for a centrifugal switch, the operating mechanism comprising:

a terminal box;

a cover;

a movable contact;

a static contact;

a swing arm;

a reset elastic part; and a shifting fork having a middle;

wherein said movable contact and said static contact are disposed in said terminal box;

said shifting fork operates to drive said swing arm to horizontally swing, whereby pushing said movable contact and implementing connection and disconnection between said movable contact and said static contact;

said reset elastic part operates to automatically reset said shifting fork and said swing arm;

said swing arm is disposed in said terminal box;

one end of said swing arm is hinged on said terminal box and capable of swinging with respect to a hinge point thereof;

the front of said swing arm pushes said movable contact;

said reset elastic part comprises a compression spring and a torsion spring;

a pair of protruding ears are extended from said terminal box; and the middle of said shifting fork is hinged on said protruding ears via a pin shaft.

* * * * *